United States Patent [19]

Scheurer

[11] Patent Number: 4,871,336

[45] Date of Patent: Oct. 3, 1989

[54] ADJUSTABLE TOE WATER SKI BINDER

[76] Inventor: Robert S. Scheurer, P.O. Box 539, Wichita Falls, Tex. 75307

[21] Appl. No.: 224,453

[22] Filed: Jul. 25, 1988

Related U.S. Application Data

[63] Continuation-in-part of Ser. No. 945,570, Dec. 23, 1986, Pat. No. 4,759,734.

[51] Int. Cl.[4] ..... A63C 15/06

[52] U.S. Cl. ..... 441/70; 441/68

[58] Field of Search ..... 441/68, 70; 280/618, 280/623, 633, 632, 634, 611–617, 619–622, 624–631, 635–637

[56] References Cited

U.S. PATENT DOCUMENTS

| | | | |
|---|---|---|---|
| 2,740,972 | 4/1956 | Taylor | 441/70 |
| 2,939,159 | 6/1960 | Cravotta | 441/70 |
| 4,296,511 | 10/1981 | Wright | 441/68 |
| 4,642,060 | 2/1987 | Scheurer et al. | 441/70 |
| 4,673,365 | 6/1987 | Scheurer et al. | 441/70 |

*Primary Examiner*—Joseph F. Peters, Jr.
*Assistant Examiner*—Edwin L. Swinehart
*Attorney, Agent, or Firm*—Dennis T. Griggs

[57] ABSTRACT

A water ski binding having slideable toe piece which has rearward extensions which are cam locked in place in tunnels in a fixed heel piece.

12 Claims, 6 Drawing Sheets

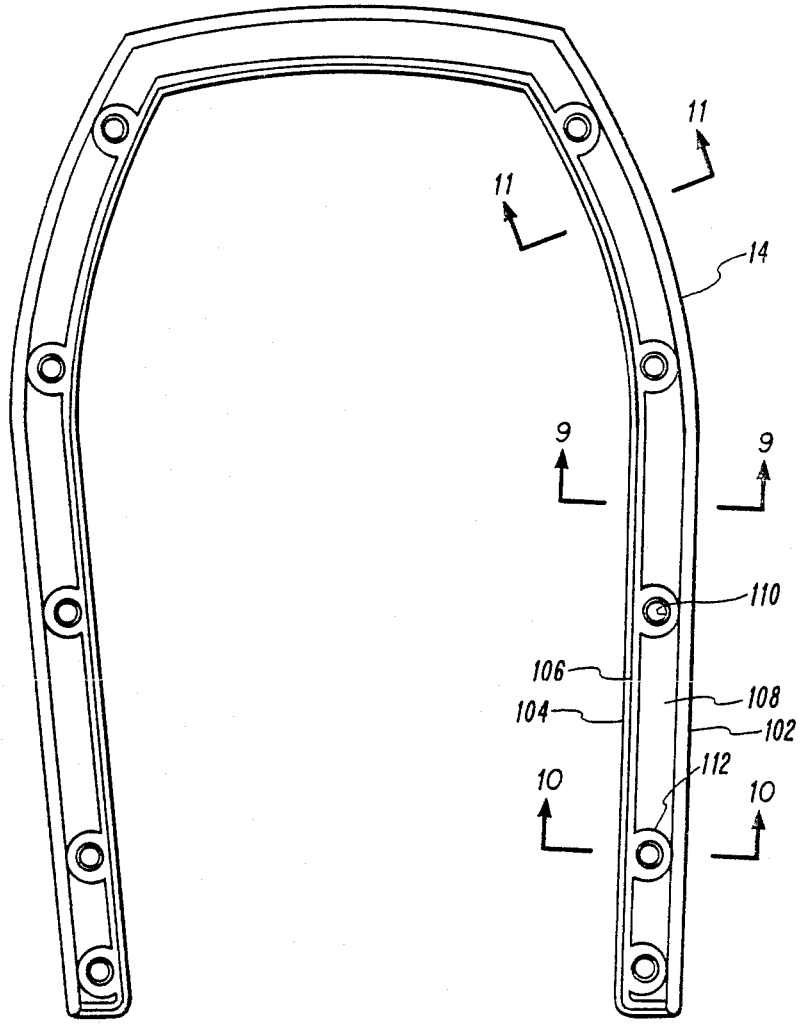
FIG. 7
FIG. 9
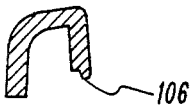
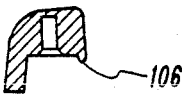
FIG. 10
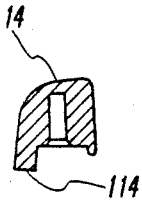
FIG. 11
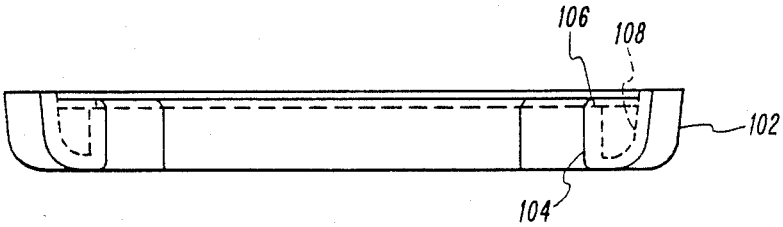
FIG. 8

FIG. 13
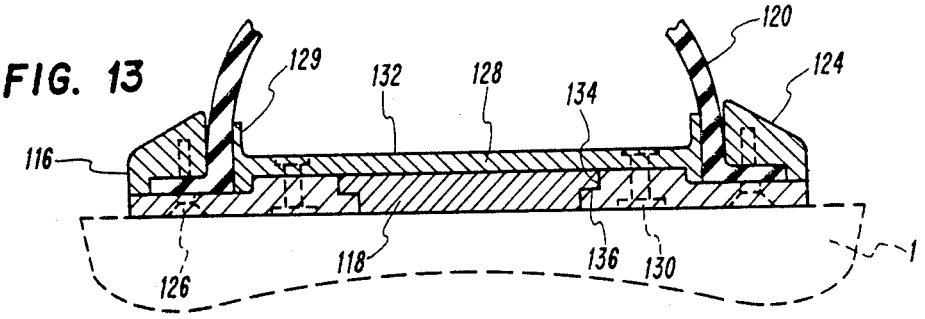
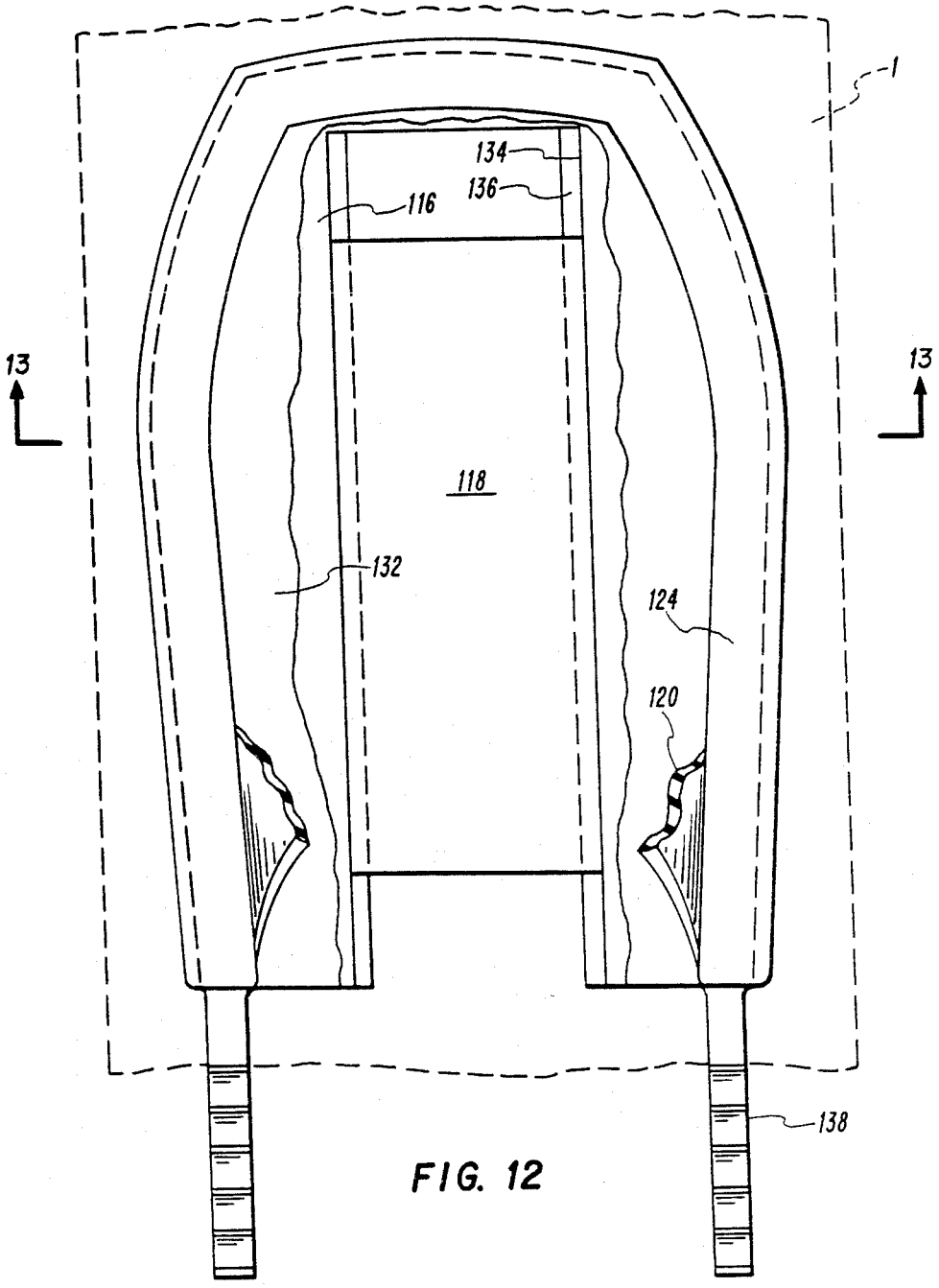
FIG. 12

ADJUSTABLE TOE WATER SKI BINDER

CROSS REFERENCE TO RELATED APPLICATION

This application is a continuation-in-part of U.S. application Ser. No. 945,570 filed Dec. 23, 1986, now U.S. Pat. No. 4,759,734, July 26, 1988.

FIELD OF THE INVENTION

This invention relates to ski equipment, and in particular to adjustable ski binders.

BACKGROUND OF THE INVENTION

In water skiing, as in other forms of skiing, it is important to precisely position the center of gravity of the skier relative to the ski. Slidably adjusting the heel cup axially to change the length of the binding moves the center of gravity, resulting in changed ski performance. In slalom ski bindings, it is important to place the trailing toe binder closely adjacent to the leading heel cup. When the leading heel cup is slid forward to adjust the foot size of the forward foot binder, the heel piece moves away from the rear toe piece, thereby changing performance characteristics of the ski.

DESCRIPTION OF THE PRIOR ART

Representative patents showing adjustable foot binders for water skis and the like are disclosed in the following U.S. patents:

| | | |
|---|---|---|
| 2,900,648 | 3,118,157 | 3,703,013 |
| 3,750,204 | 3,798,691 | 4,067,593 |
| 4,296,511 | 4,389,200 | 4,522,603 |
| 4,642,060 | 4,673,365 | 4,759,734 |

SUMMARY OF THE INVENTION

The present invention provides a rapidly and easily adjustable toe piece to quickly adjust and clamp the toe piece in position and to maintain the heel piece and center of gravity of the skier in a fixed position. The center of gravity, sometimes referred to as the center of force, applied on the ski by the skier may be considered to be the center of the skier's ankle bone. When attaching a ski to the foot, one part of the binder is slid open before inserting the foot and the binder part is then closed to capture the foot. When pesons with different size feet use the same binders, centers of force are shifted longitudinally on the ski. After the bindings have been adjusted for one person, the center of gravity may be shifted slightly and adversely by changes in binding adjustment to accommodate use by a different person. Additionally, the rear toe in a slalom mount will be positioned too far behind the heel which slides along the ski.

The adjustable toe binder of the present invention provides easy fastening of the binding in its closed position by simply pushing down on two cams and easy release by simply pulling up on the two cams.

In the preferred embodiment, toe binder includes an instep and toe cover having peripheral edges, grip means for gripping the peripheral edges, slide means for supporting the grip means and peripheral edges, track means connectable to a device on which the adjustable binding is to be mounted, for guiding the slide means forward and rearward, first locking means connected to the slide means for cooperating with second locking means connected to a fixed heel support to selectively permit and prevent movement of the slide means. The grip means comprises a U-shaped bar adapted to overlie a peripheral edge of the flexible instep and toe cover and includes means for connecting the U-shaped bar to the peripheral edges.

The slide means comprises a toe plate being generally U-shaped and having a stepped central portion slideably receiving a shoulder portion of the track means, wherein the stepped and shoulder portions provide guide means for guiding the toe plate forward and rearward.

Preferably, the slide means further includes an upper plate portion formed as a part of the toe plate and being adapted to carry a portion of a skier's foot, wherein a T-shaped passage is formed in an underlying portion of the toe plate. The track means comprises a stationary T-shaped plate slideably supporting the toe plate and corresponding in dimensions to the T-shaped groove. The toe plate and upper plate are integrally formed in a one-piece construction, with the upper plate portion bridging across the T-shaped passage.

The novel features which characterize the invention are defined by the appended claims. The foregoing and other objects, advantages and features of the invention will hereinafter appear, and for purposes of illustration of the invention, but not of limitation, exemplary embodiments of the invention are shown in the appended drawings.

BRIEF DESCRIPTION OF THE DRAWINGS

FIG. 7 is a bottom view of a clamp for securing the flexible toe and instep cover to the toe plate;

FIG. 8 is an end elevation of the toe plate and clamp shown in FIGS. 5, 6 and 7;

FIGS. 9, 10 and 11 are details taken along lines 9—9, 10—10 and 11—11 of the upper clamping member shown in FIG. 7;

FIG. 12 is a top plan view of the toe plate;

FIG. 13 is a sectional view of the toe plate shown in FIG. 12; and,

DETAILED DESCRIPTION OF THE PREFERRED EMBODIMENT

Figure 1:
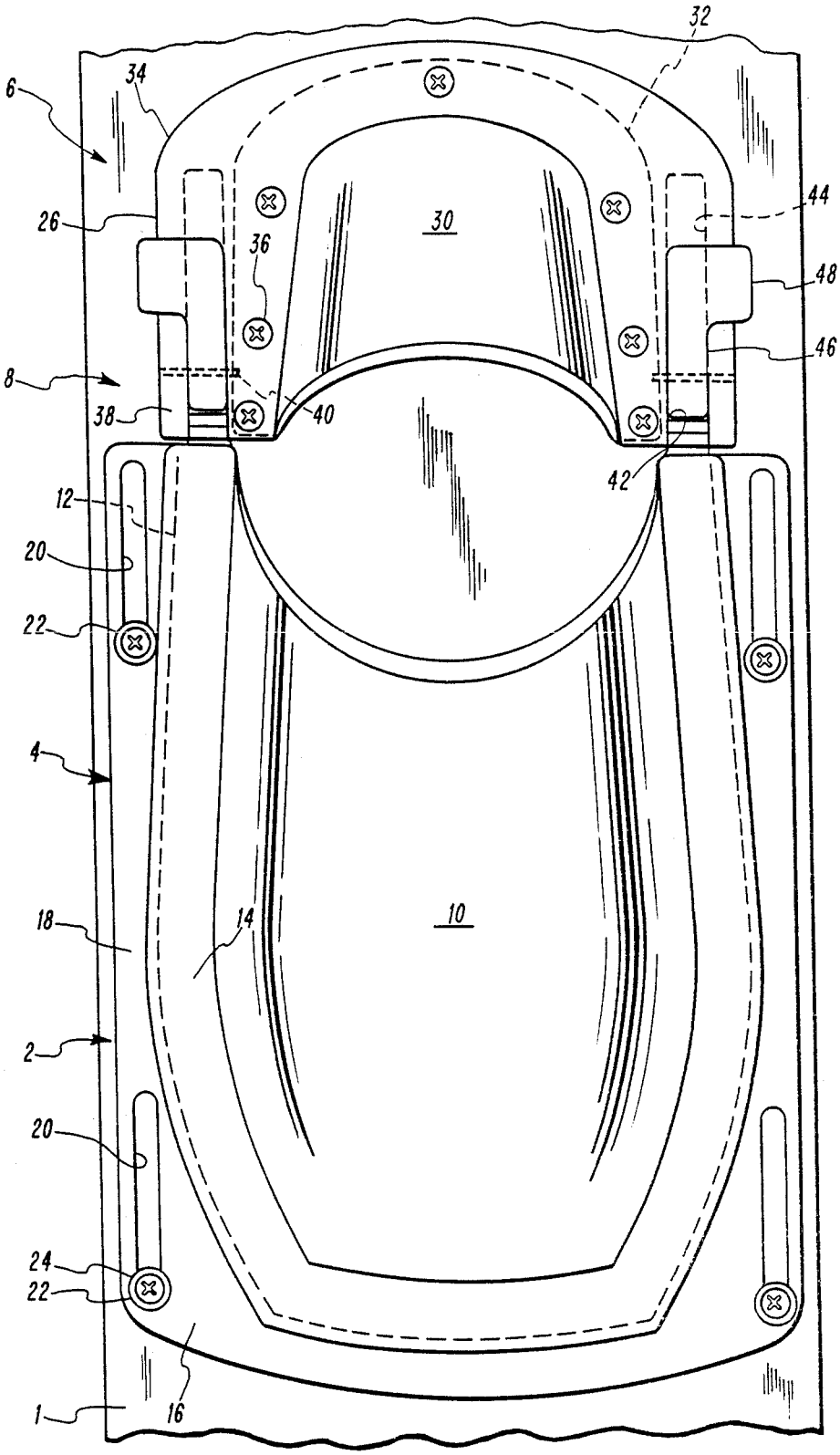
FIG. 1 is a plan view of a foot binder with the adjustable toe piece of the present invention.

In the description which follows, like parts are indicated throughout the specification and drawings with the same reference numerals, respectively. The drawings are not necessarily to scale and certain parts have been exaggerated to better illustrate details of the present invention.

In the preferred form of the invention as shown in the drawings, a ski is generally indicated by reference number 1. A binder generally indicated by the numeral 2 has a toe cover portion 4 and a heel cup portion 6. The two portions are joined by locking means generally indicated by the numeral 8. The toe portion 4 has a toe retainer generally indicated by the numeral 10 which covers the toe and instep of the skier's foot. A peripheral outward extending flange 12 of the toe cover 10 is held tightly onto the toe piece 4 by fasteners which extend into a generally U-shaped rearward opening cap clamp member 14 and similar U-shaped toe plate 16. Lateral portions 18 of toe plate 16 which extend outward from cap 14 have longitudinally extended openings 20 which slide along non-threaded outer portions of screws 22 which are anchored in the ski 1. Enlarged heads or washers 24 ride atop the lateral areas 18 of the toe plate 16, holding the toe plate firmly against the ski while permitting it to slide for adjustment.

A forward opening, flexible heel retainer cup 30 has an outward extending flange portion 32, which extends beneath a heel plate 34. Fasteners 36 pass through the peripheral flange 32 and clamp the flange 32 to the ski 1. The heel plate has internal extensions 38 which mount the locking means 8. Pins 40 extend through the openings 42 which extend upward from longitudinally extending tunnels 44 in the heel pieces 6. Eccentric cams 46 with operating levers 48 are mounted on the pins 40 as over-the-center clamps to clamp rearward extensions to the toe piece within the tunnels 44 to fix the toe piece in place on the ski.

Figure 2:
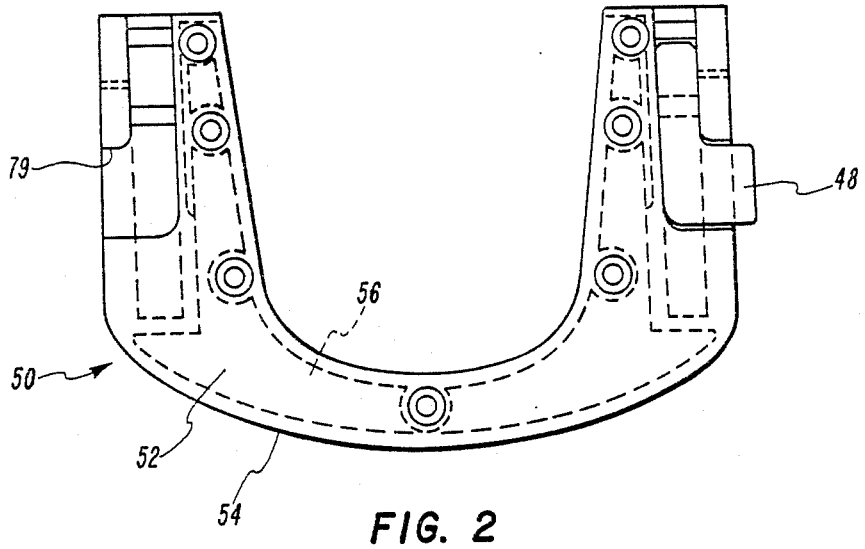
FIG. 2 is a plan view of a heel plate.

A top plan view of an alternative heel plate 50 is shown in FIG. 2. Heel plate 50 is a hollow molded piece with a generally rounded upper surface 52 and an outer wall 54 surrounding an internal hollow space 56 as can be seen with reference to the bottom view shown in FIG. 4. Inner wall 58 has a lip 60 which slightly compresses flange 32 to trap the flange between the ski 1 and the plate 50. Countersunk holes 62 are provided to receive screws which extend through the flange 32 into the ski. As shown, the screw holes 62 are formed in inward cylindrical extensions 64 of the inner wall 58. Opening 66 extends upward from a tunnel 70 and a hole 68 aligned with the opening 66 receives a pin 40 as shown in FIG. 1 for mounting the cam 46.

Figure 3:
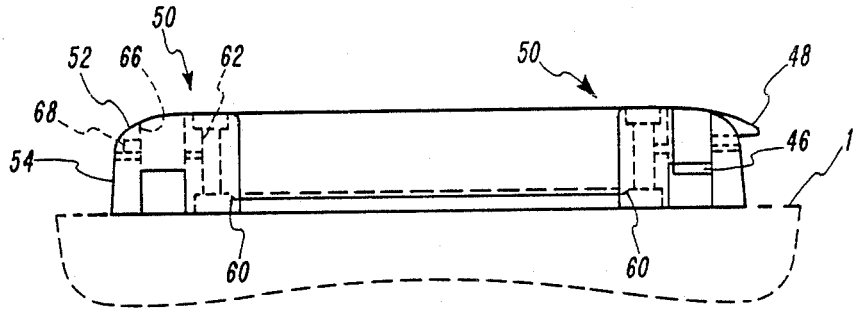
FIG. 3 is an end elevation of the heel plate shown in FIG. 2, showing the mountings of the heel cup and cam.
Figure 4:
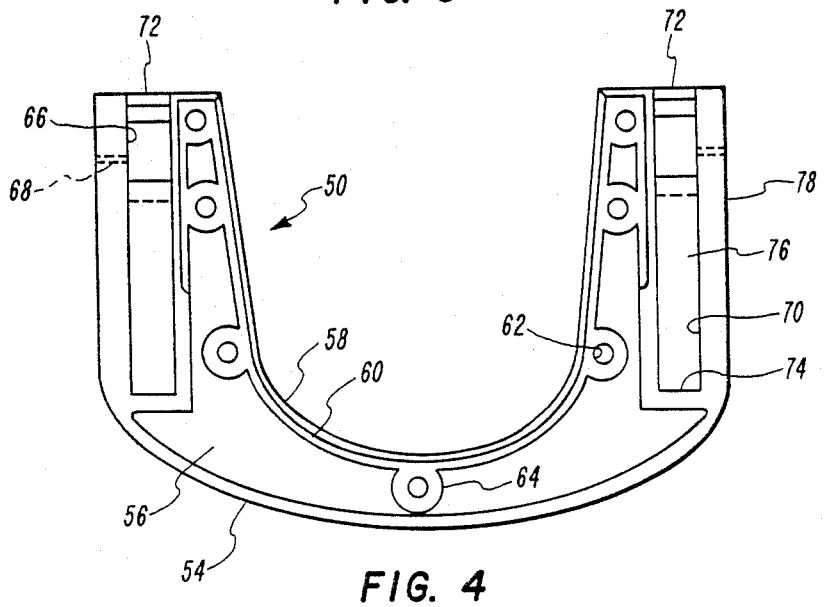
FIG. 4 is a bottom view of the heel plate shown in FIGS. 2 and 3.

Tunnels 70 as shown in FIGS. 2, 3 and 4 differ slightly from the tunnels 44 shown in FIG. 1. While the forward ends 72 of the tunnels are open, the rearward ends are closed. The relatively thick section of the top 76 of the tunnel and the outer wall 78 of the tunnel 70 supports the locking means without requiring the outer screw.

As shown in FIGS. 2 and 3, the cam lever 48 is positioned within recess 79 so that the upper surface of the cam lever is flush with the top of the heel plate and so that the outer end of the cam lever 48 may extend beyond the heel plate for ease in release.

Figures 5, 6:
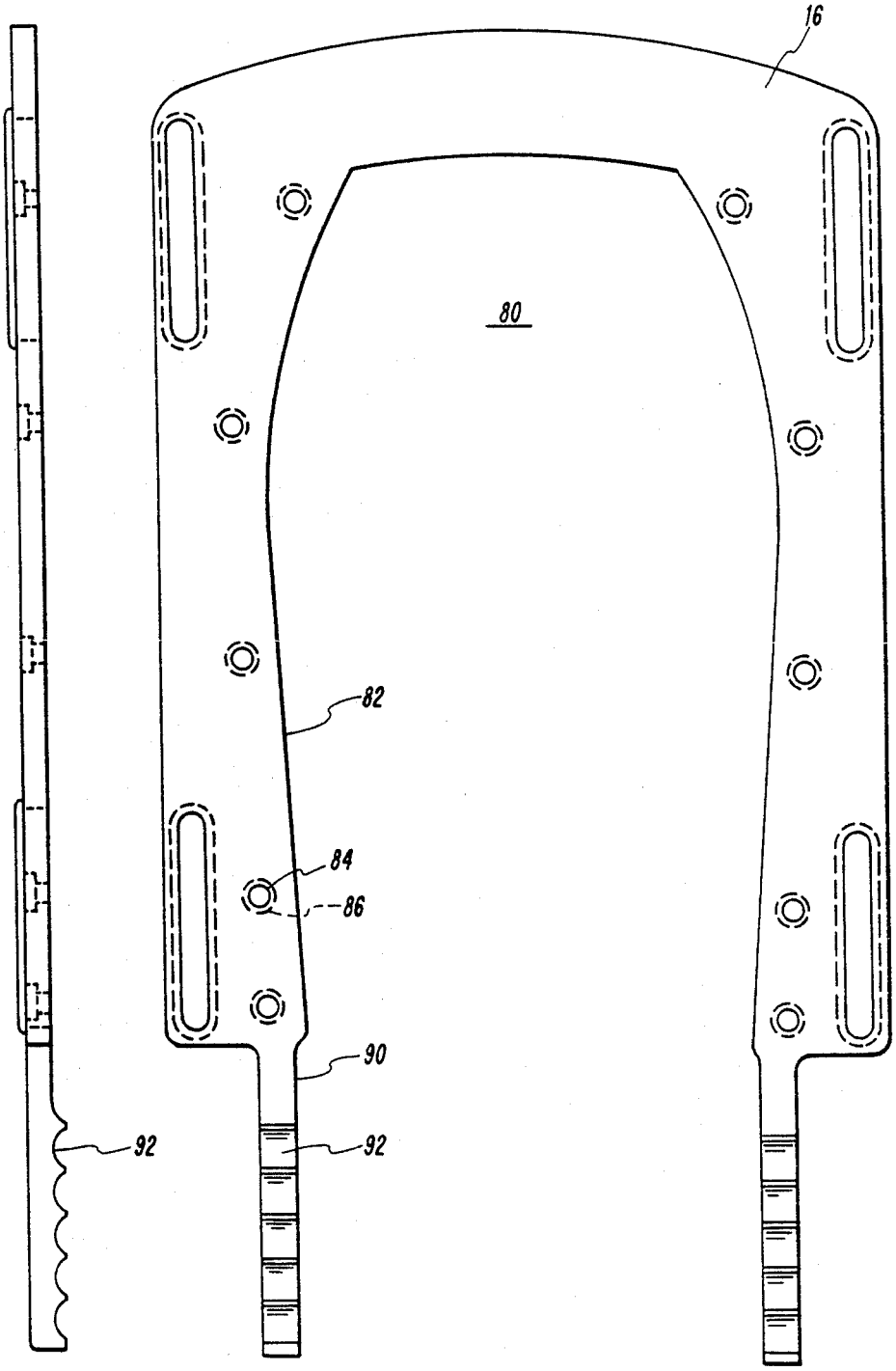
FIG. 5 is a top plan view of the toe plate shown in FIG. 1.
FIG. 6 is a side elevation of the toe plate shown in FIG. 5.

As shown in FIGS. 5 and 6, the toe plate has an open center 80 so that the foot of a user may rest directly upon the ski 1. Alternatively, the toe plate may extend across the surface of the ski beneath the foot of the user.

The inner edge 82 of the toe plate is curved inwardly and rearwardly to create the desired shape of the flexible boot and to bring the arch portion inward for foot support. Holes 84 are countersunk 86 from the bottom of the plate to receive the heads of fasteners which extend upward through the flange of the flexible toe cover and into the cap piece where they are secured. The rearward extensions 90 have detents 92 in their upper surfaces to receive the eccentric cams which are mounted in the heel piece.

As shown in FIG. 7, the clamping member 14 has an outer wall 102 which extends downward to the upper surface of the plate 16. An inner wall 104 has a lip 106 which compresses the flange 12 of the toe cover to hold the flange tightly against the plate 16. An area 108 between the walls 102 and 104 is recessed to provide weight reduction. Holes 110 in cylindrical portions 112 receive fasteners which extend through the peripheral flanges of the toe cover. The holes may be threaded to receive the fasteners or self-threading fasteners may cut threads in the material around the holes. The holes may be countersunk to aid in the centering of the screws.

As shown in FIGS. 9, 10 and 11, the distance between the bottom of the cylindrical portions 112 and the lip 106 and the base 114 of the cap 14 may vary to take into account the thicker cross section of the top cover near the stress receiving instep portion.

Referring to FIGS. 12 and 13, a toe plate 116 is mounted for fore and aft sliding movement along stationary T-track or plate 118 which is secured onto an upper surface of a ski 1 by any conventional means including screws, bolts or other fasteners and adhesive bonding. T-track 118 could also be integrally formed as a projection of the upper surface of the ski during the molding process of the ski. The T-track 118 guides the toe plate 116 while foot size adjustments are made.

The toe cover 120 is connected to an upper surface of the toe plate 116 by fitting a peripheral edge portion 122 of the toe cover 120 onto the upper surface and sandwiching the edge portion 122 between the toe plate 116 and a U-shaped bar 124. The toe plate 116, the edge portion 122 and the U-shaped bar 124 are interconnected by means of screws 126 or other suitable fasteners or fastener means which extend through bores provided in the various components.

An upper plate 128 is fixedly connected to the toe plate 116 by screws or bolts 130 or by other suitable fasteners or fastening means. An upper surface 132 of the upper plate 128 carries a portion of the skier's foot, while the opposite surface slides over and engages an upper surface of the T-track 118.

The upper plate 128 is provided with an upstanding edge 129 that helps guide the toe cover 120 upwardly to keep the toe cover from rubbing on the sides of the skier's foot. The upstanding edge 129 also makes it easier to remove and insert the skier's foot.

It should also be understood that the toe cover 120 can be open in the front to expose the toes of the skier's foot. In that case, it may be necessary to open the U-shaped bar 124 by removing the forward portion thereof. It may also be necessary to remove the forwardmost portion of the upstanding edge 129. If the open-toed embodiment is used, the U-shaped bar 124 may instead be broken into two parallel opposite side portions which are screw connected in the same manner as illustrated in FIG. 13.

Figure 14:
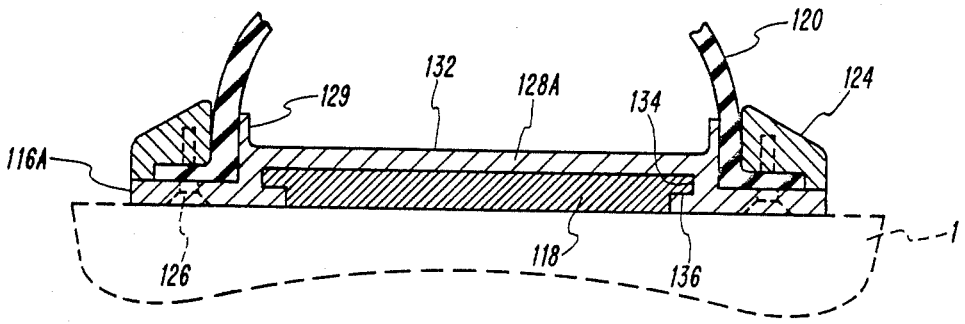
FIG. 14 is a sectional view similar to FIG. 13 illustrating an alternative embodiment in which the toe plate and upper plate are integrally formed in a one-piece construction.

Referring now to FIG. 14, toe plate 116A and upper plate 128A are integrally formed in a molding process. Preferably, the T-track 118 has a shoulder portion 134 which mates with stepped portion 136 of the toe plate 116A. The shoulder and step arrangement limits the movement of the toe plate 116A to fore and aft movement. The desired location of the toe plate 116 is locked into place by the rearward extensions 138 which are used in a similar fashion to rearward extension 90. In the foregoing preferred embodiment, the upper plate portion 128A forms a bridge over the T-shaped passage.

Because the T-track 118 provides substantial support and stability on both sides of the toe plate, one of the two extensions 138 may be eliminated, and this would avoid the requirement for corresponding and cooperating structure in the heel binding.

In either case, whether one or two extensions are used, the extensions may be arranged such that the cam can be mounted on the side instead of on top. In other words, with slight variations, the embodiment of FIG. 1 could be arranged such that the extensions are turned 90 degrees and also the lever 48 could be mounted for rotation on the side of the heel binding.

In another variation, the embodiments of both FIGS. 1 and 12 could be modified such that the front of the toe binding is "open-toed", meaning that instead of being substantially U-shaped, the forwardmost portion of the toe binding which extends across and in front of the user's toes would be removed, leaving an open area through which the toes could extend. In the embodiment of FIG. 12, the toe cover 120 would have an open forward portion and the U-shaped bar would consist of two parallel opposite side portions which are not interconnected at the front as shown in FIG. 12.

The length of the T-track 118 is proportional to the amount of adjustment desired in the toe binding. Stops may be provided at either end of the toe plate to prevent the toe plate from separating from the T-track, if desirable.

While the invention has been described with reference to specific embodiments, modifications and variations may be constructed without departing from the scope of the invention which is defined in the following claims.

What is claimed is:

1. Adjustable toe binder apparatus comprising:

a flexible instep and toe cover having peripheral edges; grip means for gripping the peripheral edges; slide means for supporting the grip means and peripheral edges; guiding means coupled to the slide means for guiding the slide means forward and rearward; first locking means mounted on the slide means and second locking means connected to a fixed heel support for cooperating with the first locking means to selectively permit and prevent movement of the slide means; said slide means including a toe plate having an upper plate portion for supporting a skier's foot, and having a track passage extending beneath said upper plate portion for receiving said guiding means.

2. Foot binder apparatus for water skis comprising:

a flexible end opening cover having a generally U-shaped base with laterally outwardly extending peripheral flange portions;

a generally U-shaped face plate having an inner portion configured for overlying an outward extending flange portion of the flexible cover and trapping the flange portion between the water ski and the inner portion of the plate and fastener means extending through the inner portion of the plate and the laterally extending flange portions for securing the cover and the plate to the water ski in a fixed position;

a flexible second cover having an opposite opening and having a peripheral outwardly extending flange on a lower edge thereof;

a generally U-shaped second plate having an inner portion for receiving the peripheral flange of the second cover and a generally U-shaped cap means for overlying the second cover flange and fastener means extending through the cover flange for holding the cover flange, cap means and plate assembled, a guide channel formed within the second plate and extending longitudinally with respect to the ski for permitting longitudinal sliding movement of the second plate with respect to guide bar means mounted onto the ski; and, grip means for preventing movement of the second plate away from the ski while permitting movement of the second plate along the ski and first and second adjustable locking means respectively connected to the second plate and to the first mentioned plate for locking the second plate in a preselected position with respect to the first plate.

3. The apparatus of claim 2 wherein the first and second locking means comprise extensions, receivers and cams for locking the extensions in the receivers.

4. The apparatus of claim 2 wherein the first locking means comprise extensions at opposite ends of the U-shaped second plate, and the second locking means comprise receivers in opposite ends of the U-shaped first plate.

5. The apparatus of claim 4 wherein the receivers are tunnel shaped.

6. The apparatus of claim 3 wherein the second locking means further comprises pins positioned in the first plate and extending transversely with respect to the ski and positioned above the receivers, cams mounted on the pins and levers connected to the cams to move the cams selectively toward and away from the extensions in the receivers to lock the extensions in place or release the extensions.

7. The apparatus of claim 6 wherein the extensions have upward facing detents for receiving the cams in selected positions, and the extensions extend rearward from ends of the second plate and wherein the receivers open forward to receive the extensions.

8. The apparatus of claim 2 wherein the second plate comprises:

a toe plate being generally U-shaped and having a stepped central portion slideably receiving a shoulder portion of the guide bar means, wherein the stepped and shoulder portions provide guide means for guiding the toe plate forward and rearward.

9. The apparatus of claim 2 wherein the second plate further comprises:

an upper plate-portion having an upper surface adapted to carry a portion of a skier's foot, and said guide channel being a T-shaped channel disposed within a lower portion of the second plate and having inner stepped side walls, said upper plate portion bridging over said T-shaped channel.

10. The apparatus of claim 9 wherein said guide bar means comprises:

a stationary T-shaped bar slideably supporting the second plate and corresponding in dimensions to the T-shaped channel.

11. The apparatus of claim 2 wherein the second plate and upper plate portion are integrally formed in a one-piece construction.

12. The apparatus of claim 2 wherein the grip means comprises opposite side bars adapted to overlay a peripheral edge of the flexible second cover, wherein the flexible second cover has an opening at a forward portion thereof and wherein the second plate includes a stepped central portion slideably engaging a shoulder portion of the guide bar means, wherein the stepped and shoulder portions provide guide means for guiding the second plate forward and rearward, and wherein the first locking means comprises a single extension cooperating with the second locking means, wherein the second locking means comprises a receiver.

* * * * *